US010717304B2

(12) United States Patent
Sumii et al.

(10) Patent No.: US 10,717,304 B2
(45) Date of Patent: Jul. 21, 2020

(54) RECORDING APPARATUS

(71) Applicant: SEIKO EPSON CORPORATION, Tokyo (JP)

(72) Inventors: Atsushi Sumii, Shiojiri (JP); Soichiro Kll, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/455,933

(22) Filed: Jun. 28, 2019

(65) Prior Publication Data

US 2020/0001628 A1 Jan. 2, 2020

(30) Foreign Application Priority Data

Jun. 28, 2018 (JP) ..... 2018-122978

(51) Int. Cl.

| | |
|---|---|
| ***B41J 3/60*** | (2006.01) |
| ***B41J 11/04*** | (2006.01) |
| ***B41J 2/01*** | (2006.01) |
| ***B41J 11/42*** | (2006.01) |
| ***B65H 85/00*** | (2006.01) |

(52) U.S. Cl.

CPC ..... *B41J 11/04* (2013.01); *B41J 2/01* (2013.01); *B41J 3/60* (2013.01); *B41J 11/42* (2013.01); *B65H 85/00* (2013.01); *B65H 2301/333* (2013.01); *B65H 2301/33214* (2013.01)

(58) Field of Classification Search

CPC ..... B41J 11/04; B41J 2/01; B41J 3/60; B41J 11/42; B65H 85/00; B65H 2301/33214; B65H 2301/333

See application file for complete search history.

(56) References Cited

U.S. PATENT DOCUMENTS

| | | | | |
|---|---|---|---|---|
| 8,672,568 | B2 * | 3/2014 | Okano | B41J 3/60 400/607.2 |
| 9,427,982 | B2 * | 8/2016 | Ohashi | B65H 85/00 |
| 10,412,238 | B2 * | 9/2019 | Otsuka | B65H 85/00 |
| 2003/0052442 | A1 * | 3/2003 | Thogersen | B65H 15/00 270/58.12 |
| 2008/0068632 | A1 * | 3/2008 | Fukasawa | B41J 3/60 358/1.12 |

(Continued)

FOREIGN PATENT DOCUMENTS

| | | | |
|---|---|---|---|
| JP | 2012240813 | * 12/2012 | B65H 5/06 |
| JP | 2014-196159 | 10/2014 | |
| JP | 2015-037839 | 2/2015 | |

*Primary Examiner* — Huan H Tran

(74) *Attorney, Agent, or Firm* — Workman Nydegger

(57) ABSTRACT

A printer includes an inversion path that inverts a medium, an inversion roller having a circumferential surface that serves as a path surface of the inversion path, an advancing roller having a circumferential surface that faces both a first path that is a path before the medium is inverted and a second path that is a path after the medium is inverted. The printer also includes an idler roller disposed above the inversion roller and a supply mechanism that is disposed above the idler roller and that supplies the medium toward the recording head. The inversion roller is made smaller in diameter than the advancing roller, and the inversion roller is positioned within a height range of the advancing roller, and at least part of the idler roller is positioned within the height range of the advancing roller.

12 Claims, 10 Drawing Sheets

(56) References Cited

U.S. PATENT DOCUMENTS

| | | | | |
|---|---|---|---|---|
| 2014/0292976 | A1* | 10/2014 | Ohashi | B41J 3/60<br>347/104 |
| 2015/0062228 | A1* | 3/2015 | Ogimura | B41J 13/02<br>347/16 |
| 2019/0160835 | A1* | 5/2019 | Sumii | B41J 13/0045 |

* cited by examiner

RECORDING APPARATUS

The present application is based on, and claims priority from JP Application Serial Number 2018-122978, filed Jun. 28, 2018, the disclosure of which is hereby incorporated by reference herein in its entirety.

BACKGROUND

1. Technical Field

The present disclosure relates to a recording apparatus that performs recording onto a medium.

2. Related Art

A recording apparatus, of which a typical example is an ink jet printer that performs recording by ejecting ink (i.e., liquid) onto a medium, may be configured to perform double-sided recording. In the double-sided recording, the recording apparatus causes a recording device to perform recording on a first side of the medium and sends the medium to an inversion path where the medium is inverted. The recording apparatus subsequently sends the medium once again to a recording region of the recording device where recording is performed on a second side that is opposite to the first side.

As disclosed in JP-A-2014-196159, in order to provide a sufficient length of the inversion path so as to meet a large-size medium, for example, such a recording apparatus may include a first roller having a circumferential surface that serves as part of the inversion path and a second roller disposed so as to form a row with the first roller in a medium transporting direction. The circumferential surface of the second roller opposes both a medium transport path before the medium is inverted by the first roller and the medium transport path after the medium is inverted, and the circumferential surface applies a transporting force to the medium. In the recording apparatus disclosed by the JP-A-2014-196159, the first roller and the second roller are formed so as to have the same diameter.

When double-sided recording is performed on a medium, the medium may curl with the first side facing outward after first-side recording. If the medium curls in such a manner, an end of the medium may bend toward the recording device and the medium may come into contact with the recording device when recording is performed on the second side. To suppress such curling, decurling may be performed in such a manner that the recording apparatus stops the medium or slows down the medium transport speed on the inversion path so as to reduce or remedy the curling of the medium. However, decurling leads to a decrease in the throughput of recording operation.

In addition, for example, there may be disposed, above the inversion path, a feed device that feeds media to the medium transport path or other constituent section such as an image reading apparatus for reading document images. If a plurality of constituent sections are stacked vertically, the size of the apparatus increases in the height direction.

SUMMARY

The present disclosure provides a recording apparatus that includes a recording device that performs recording onto a medium, an inversion path that inverts the medium transported in a reverse transporting direction that is opposite to a medium transporting direction while the recording device performing recording, an inversion roller having a circumferential surface that serves as a path surface of the inversion path, the inversion roller applying a transporting force to the medium, an advancing roller having a circumferential surface that faces both a first path that is a medium transport path before the medium is inverted by the inversion roller and a second path that is a medium transport path after the medium is inverted, the advancing roller applying a transporting force to the medium, a first inversion idler roller that is disposed above the inversion roller and nips and transports the medium after the inversion in collaboration with the inversion roller, and an upper supply mechanism that is disposed above the first inversion idler roller and supplies the medium toward the recording device. In the recording apparatus, the inversion roller is made smaller in diameter than the advancing roller, and the inversion roller is positioned within a height range in which the advancing roller extends in a height direction, and at least part of the first inversion idler roller is positioned within the height range of the advancing roller.

DESCRIPTION OF EXEMPLARY EMBODIMENTS

Figure 1:
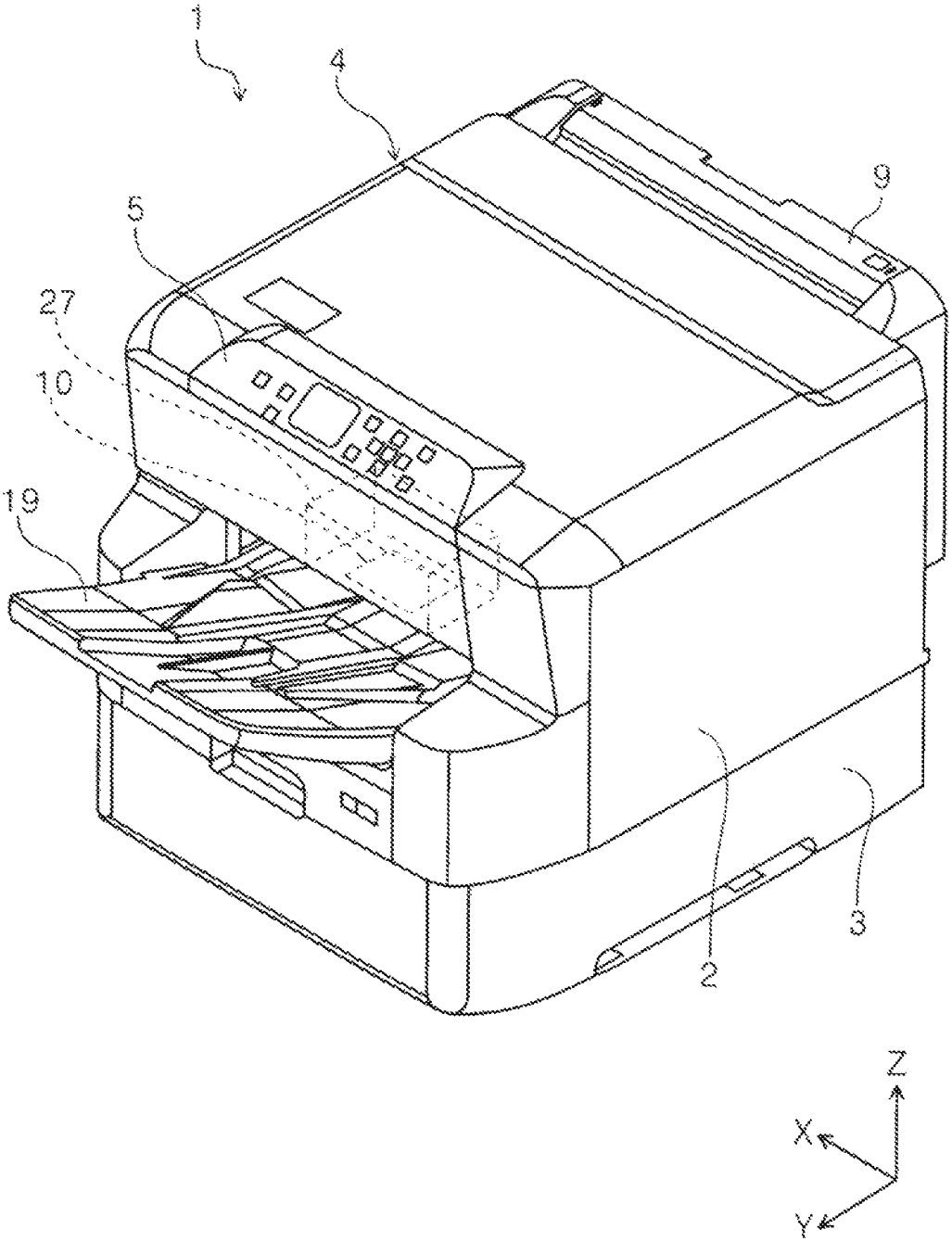
FIG. 1 is a perspective view illustrating the exterior of a printer according to the disclosure.

The following describes some aspects of the disclosure generally. A recording apparatus according to a first aspect of the present disclosure includes a recording device that performs recording onto a medium, an inversion path that inverts the medium transported in a reverse transporting direction that is opposite to a medium transporting direction while the recording device performing recording, an inversion roller having a circumferential surface that serves as a path surface of the inversion path, the inversion roller applying a transporting force to the medium, an advancing roller having a circumferential surface that faces both a first path that is a medium transport path before the medium is inverted by the inversion roller and a second path that is a medium transport path after the medium is inverted, the advancing roller applying a transporting force to the medium, a first inversion idler roller that is disposed above the inversion roller and nips and transports the medium after the inversion in collaboration with the inversion roller, and an upper supply mechanism that is disposed above the first inversion idler roller and supplies the medium toward the recording device. In the recording apparatus, the inversion roller is made smaller in diameter than the advancing roller, and the inversion roller is positioned within a height range in which the advancing roller extends in a height direction, and at least part of the first inversion idler roller is positioned within the height range of the advancing roller.

According to this configuration, the inversion roller is made smaller in diameter than the advancing roller, and accordingly, the curvature of the circumferential surface of the inversion roller becomes greater. This provides better performance in decurling, by which curling of a medium is remedied, compared with the case where the inversion roller and the advancing roller have the same diameter. Accordingly, the medium can be decurled for a shorter period of time. Thus, throughput in double-sided recording can be improved. In addition, the inversion roller is positioned within a height range in which the advancing roller extends in a height direction, and at least part of the first inversion idler roller is positioned within the height range of the advancing roller. Accordingly, the first inversion idler roller can be disposed at a lower position compared with the case where the inversion roller and the advancing roller have the same diameter. The upper supply mechanism to be located above the first inversion idler roller can be thereby disposed at a lower position compared with the case where the inversion roller and the advancing roller have the same diameter. Thus, the size of the apparatus can be reduced in the height direction.

In the recording apparatus according to the disclosure, both of the inversion roller and the first inversion idler roller may be positioned as a whole within the height range of the advancing roller.

According to this configuration, both of the inversion roller and the first inversion idler roller are positioned as a whole within the height range of the advancing roller, which can thereby provide a larger space above the first inversion idler roller.

In the recording apparatus according to the disclosure, the inversion roller and the advancing roller may have respective bottom ends that are disposed at the same position in the height direction.

According to this configuration, the inversion roller and the advancing roller have respective bottom ends that are disposed at the same position in the height direction, which can thereby provide a larger space above the first inversion idler roller.

The recording apparatus according to the disclosure may further include a first advancing idler roller that is disposed above the advancing roller and nips and transports the medium in collaboration with the advancing roller, and in the recording apparatus, the upper supply mechanism may include an upper medium feed path that merges into the second path at a position upstream of the nip between the advancing roller and the first advancing idler roller.

With this configuration, the medium fed by the upper supply mechanism can be transported into the second path at the position upstream of the nip between the advancing roller and the first advancing idler roller and can be sent further toward the recording device.

The recording apparatus according to the disclosure may further include a second inversion idler roller that is disposed below the inversion roller and nips and transports the medium before the inversion in collaboration with the inversion roller, and in the recording apparatus, the path surface of the inversion path may be the circumferential surface of the inversion roller between a first position that is the nip between the inversion roller and the first inversion idler roller and a second position that is the nip between the inversion roller and the second inversion idler roller.

With this configuration, the medium can reliably follow the circumferential surface (i.e., the path surface of the inversion path) of the inversion roller between the first nip and the second nip, and thereby decurling of the medium can be performed effectively.

The recording apparatus according to the disclosure may further include a detachable unit that is attachable to and detachable from the apparatus body, and in the recording apparatus, the inversion roller, the advancing roller, the first inversion idler roller, and the second inversion idler roller may be disposed in the detachable unit.

With this configuration, the inversion roller, the advancing roller, the first inversion idler roller, and the second inversion idler roller are disposed integrally in the detachable unit, and the entire unit is detachably mounted in the apparatus body, which thereby facilitates handling of sheet jamming or the like in the medium transport path.

The recording apparatus according to the disclosure may further include a third inversion idler roller that nips the medium with the inversion roller at a third position located between the first position and the second position and may also include a lower supply mechanism that supplies the medium toward the recording device from a medium accommodation section disposed below the second inversion idler roller. In addition, in the recording apparatus, the lower supply mechanism may include a lower medium feed path that merges into the inversion path at a position upstream of the third position.

According to this configuration, the recording apparatus includes a third inversion idler roller that nips the medium with the inversion roller at a third position located between the first position and the second position and also include a lower supply mechanism that supplies the medium toward the recording device from a medium accommodation section disposed below the second inversion idler roller, and in the recording apparatus, the lower supply mechanism includes a lower medium feed path that merges into the inversion path at a position upstream of the third position. With this configuration, decurling of the medium can be performed effectively, and sheet jamming or the like can be handled easily.

The recording apparatus according to the disclosure may further include a first transport roller pair that nips and transports the medium at a position located upstream of the recording device in the medium transporting direction and may also include a second transport roller pair that nips and transports the medium at a position located downstream of the recording device in the medium transporting direction. In the recording apparatus, the recording device may include a plurality of nozzles that are spaced apart from each other in the medium transporting direction and may be configured to perform recording by ejecting liquid from the nozzles onto the medium. In addition, in the recording apparatus, both $L1 \leq L4 < L3$ and $L2 \leq L4 < L3$ may be satisfied, wherein, in the medium transporting direction, L1 is a distance from a fourth position that is the nip of the first transport roller pair to the most downstream nozzle of the recording device, L2 is a distance from a fifth position that is the nip of the second transport roller pair to the most upstream nozzle of the recording device, L3 is a distance from the fourth position to the fifth position, and L4 is a distance along the inversion path from the first position to the second position.

According to this configuration, the recording apparatus further includes a first transport roller pair that nips and transports the medium at a position located upstream of the recording device in the medium transporting direction, and a second transport roller pair that nips and transports the medium at a position located downstream of the recording device in the medium transporting direction. In the recording apparatus, the recording device includes a plurality of nozzles that are spaced apart from each other in the medium transporting direction and is configured to perform recording by ejecting liquid from the nozzles onto the medium. In addition, in the recording apparatus, both $L1 \leq L4 < L3$ and $L2 \leq L4 < L3$ is satisfied, wherein, in the medium transporting direction, L1 is a distance from a fourth position that is the nip of the first transport roller pair to the most downstream nozzle of the recording device, L2 is a distance from a fifth position that is the nip of the second transport roller pair to the most upstream nozzle of the recording device, L3 is a distance along the inversion path from the fourth position to the fifth position, and L4 is a distance from the first position to the second position. With this configuration, decurling of the medium can be performed effectively, and sheet jamming or the like can be handled easily.

The recording apparatus according to the disclosure may further include a control section that controls transport of the medium. In the recording apparatus, in a case of double-sided recording on both a first side of the medium and a second side that is opposite to the first side, the control section may be configured to perform a first control operation by which a medium transport speed is made slower than a medium transport speed set for recording when the medium is sent to the inversion path following first-side recording and a leading end of the medium is nipped at the second position.

According to this configuration, the recording apparatus further includes a control section that controls transport of the medium. In addition, in the recording apparatus, in a case of double-sided recording on both a first side of the medium and a second side that is opposite to the first side, the control section is configured to perform a first control operation by which a medium transport speed is made slower than a medium transport speed set for recording when the medium is sent to the inversion path following first-side recording and a leading end of the medium is nipped at the second position, in other words, the leading end of the medium is located between the first position and the second position of the inversion path. Accordingly, curling of the medium, by which the medium bends with the recorded surface facing outward, can be remedied. Note that the term "made slower" above may include a case where the medium is stopped and the transport speed becomes zero.

In the recording apparatus according to the disclosure, the control section may perform the first control operation in response to an amount of liquid ejected on the first side.

The more the amount of liquid ejected on the first side, the more the amount of curling after the first-side recording. Accordingly, if the amount of liquid ejected on the first side is small, the curling does not tend to be large. According to this configuration, the control section performs the first control operation in response to an amount of liquid ejected on the first side. Accordingly, for example, in the case of recording in which the liquid discharge amount is small on the first side and the curling is not likely to be large, the first control operation is omitted, which can reduce the likelihood of the throughput decreasing due to the first control operation.

In the recording apparatus according to the disclosure, a plurality of the inversion rollers may be provided and spaced apart from each other in a width direction that intersects the medium transporting direction, and a plurality of the advancing rollers may be provided and spaced apart from each other in the width direction.

According to this configuration, by disposing the inversion rollers and the advancing rollers both of which are spaced apart in the width direction intersecting the medium transporting direction, the medium can be transported stably by the inversion rollers and the advancing rollers.

In the recording apparatus according to the disclosure, the number of the inversion rollers may be greater than the number of the advancing rollers.

According to this configuration, the number of the inversion rollers are greater than the number of the advancing rollers, and accordingly, decurling of the medium can be performed effectively by the inversion rollers.

Now, the present disclosure will be described more specifically.

First Embodiment

A recording apparatus of an embodiment according to the disclosure will be described with reference to the drawings. As an example of the recording apparatus, an ink jet printer 1 will be described below. The ink jet printer 1 is simply referred to as a "printer 1". In the X-Y-Z coordinate system shown in the drawings, the X direction is a scanning direction of a recording head that serves as a recording device, in other words, the width direction of a medium on which recording is performed. The Y direction is the depth direction of the apparatus generally parallel to a medium transporting direction. The Z direction is the height direction of the apparatus parallel to the gravity direction. In addition, the front side of the apparatus is defined as the side in the +Y direction, and the rear side of the apparatus is defined as the side in the −Y direction. Similarly, as viewed from the front side, the left side of the apparatus is defined as the side in the +X direction, and the right side of the apparatus is defined as the side in the −X direction. The top side of the apparatus is defined as the side in the +Z direction (which also applies to an upper portion and an upper surface), and the bottom side of the apparatus is defined as the side in the −Z direction (which also applies to a lower portion and a lower surface). In the description, a region toward which a medium is transported in the printer 1 is referred to as a "downstream" region and a region in the opposite direction is referred to as an "upstream" region.

Outline of Printer

Figure 2:
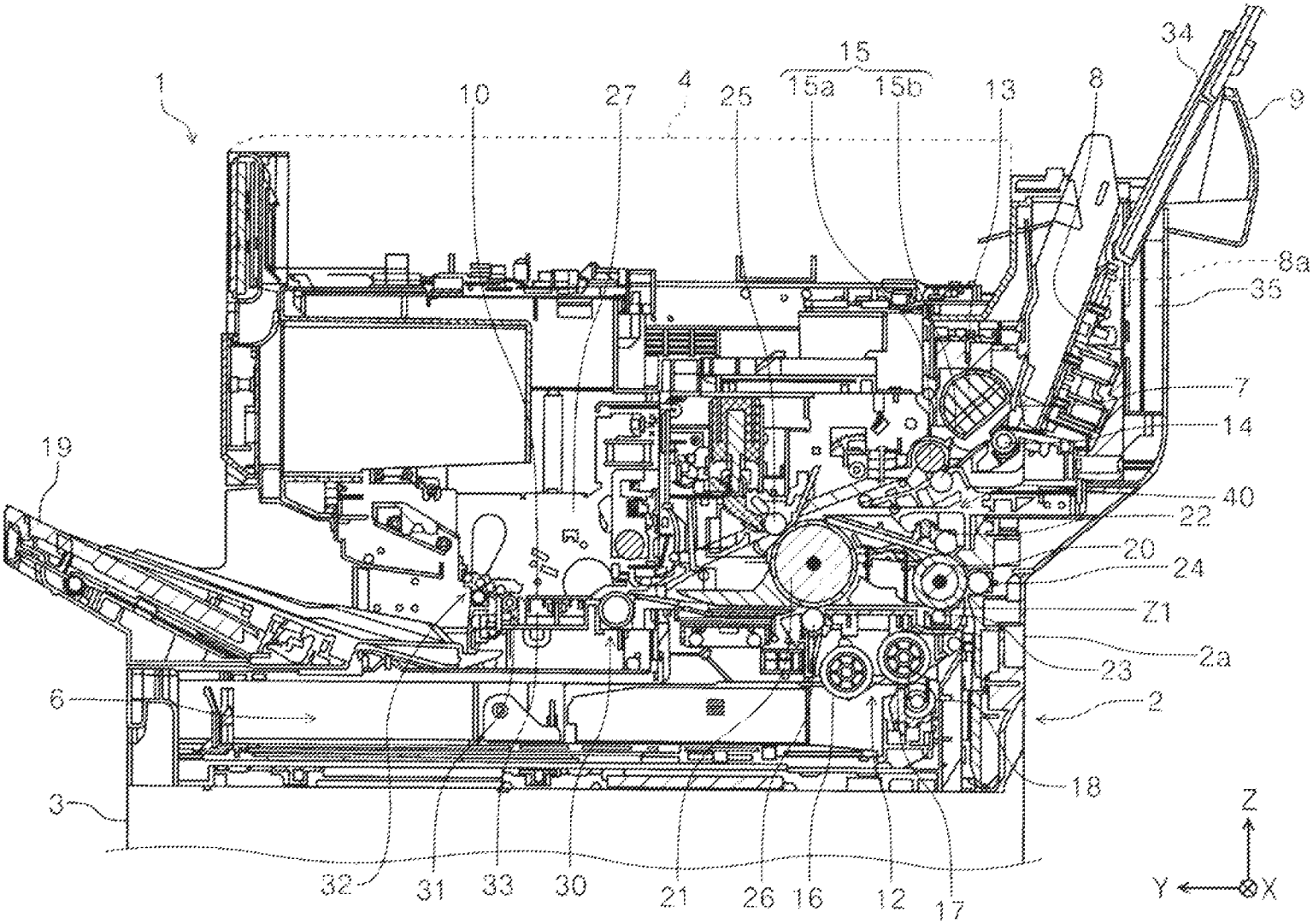
FIG. 2 is a cross-sectional side view illustrating the printer according to the disclosure.
Figure 3:
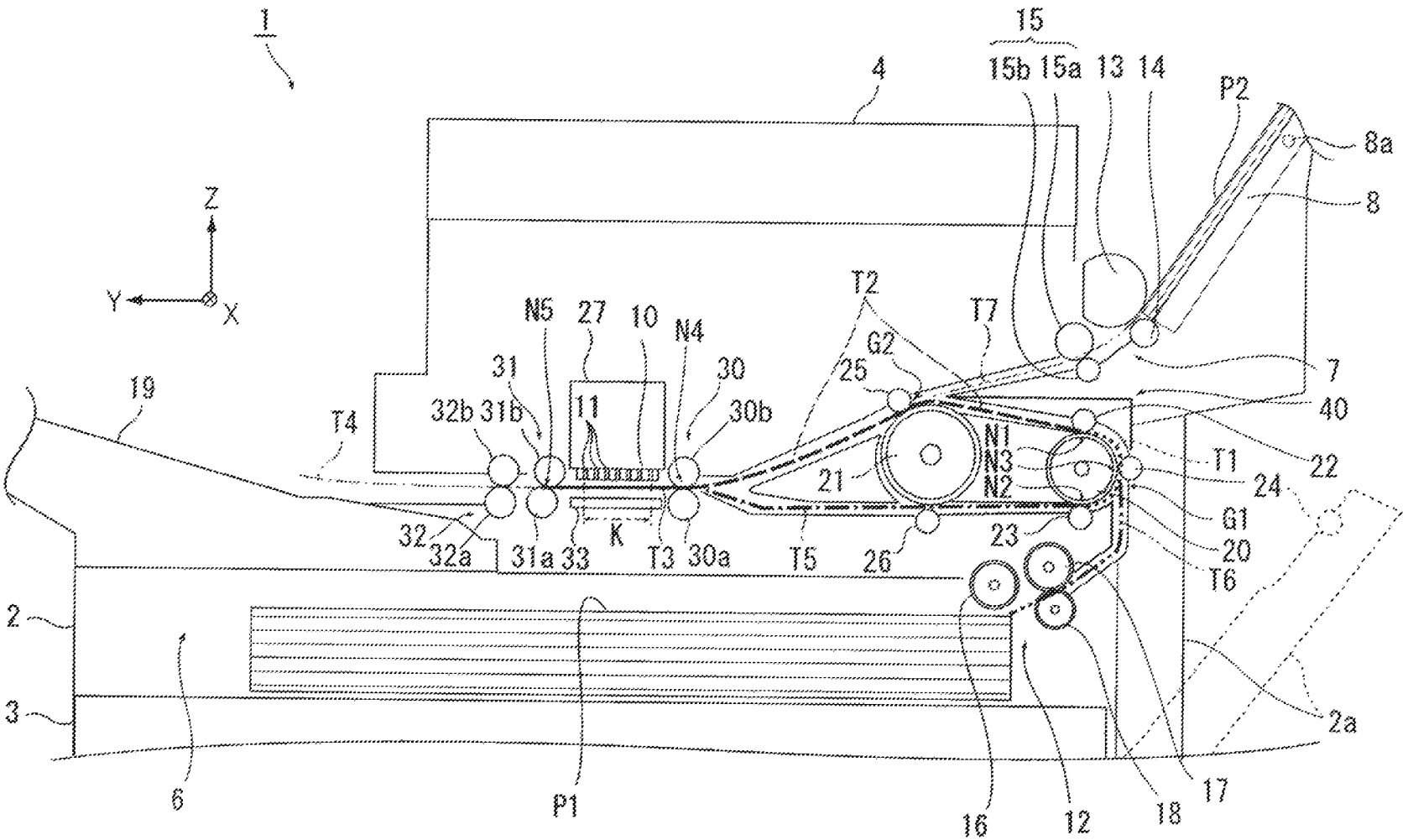
FIG. 3 is a cross-sectional side view schematically illustrating medium transport paths in the printer.

The printer 1 will be outlined with reference to FIGS. 1 to 3. The printer 1 illustrated in FIG. 1 includes a recording unit 2 and a liquid container unit 3. As illustrated in FIG. 2, the recording unit 2 contains various constituent elements including a recording head 10 that serves as a "recording device" for performing recording onto the medium. As illustrated in FIG. 3, a plurality of nozzles 11 spaced apart from each other in the Y direction, in other words, in the medium transporting direction, are arranged on a head surface disposed at the bottom of the recording head 10. The recording head 10 is mounted on a carriage 27 that is movable in the X direction, in other words, in the width direction of the apparatus. While moving in the X direction, the carriage performs recording by causing the nozzles 11 to eject ink, in other words, "liquid", onto a medium. Accordingly, the recording head 10 is formed as an ink jet type recording head. Types of media on which recording is performed in the printer 1 are, for example, various sheets of paper for recording, such as thin paper, thick paper, coated paper such as photo paper as well as standard paper.

In addition to the recording function, the printer 1 can be formed, for example, as a multifunction printer having a document reading function, in other words, a scanner. In the present embodiment, a scanner section 4 is provided in an upper portion of the recording unit 2. Note that structural details of the scanner section 4 are omitted in FIG. 2. As illustrated in FIG. 1, an operation section 5 for operating the printer 1 including the scanner section 4 is disposed in a front region on the top side of the apparatus.

A liquid container (not illustrated) that contains ink to be supplied to the recording head 10 is accommodated in the liquid container unit 3 illustrated in FIG. 1. Ink is supplied to the recording head 10 from the liquid container accommodated in the liquid container unit 3 via a tube (not illustrated).

As illustrated in FIG. 2, an upper supply mechanism 7 that supplies media toward the recording head 10 is disposed in the recording unit 2. In FIG. 1, an upper cover 9, which opens/closes the opening of a medium setting section 8 for setting media for the upper supply mechanism 7, is disposed in an upper rear portion of the apparatus of FIG. 2. As illustrated in FIG. 2, when the upper cover 9 is open, media can be fed by using the upper supply mechanism 7. The upper supply mechanism 7 is disposed above a first inversion idler roller 22, which will be described later.

In addition, as illustrated in FIG. 2, a medium tray 6, which serves as a "medium accommodation section", and a lower supply mechanism 12 are disposed in a lower region of the recording unit 2. The lower supply mechanism 12 supplies media from the medium tray 6 toward the recording head 10. The recording head 10 performs recording on a medium supplied by the upper supply mechanism 7 or by the lower supply mechanism 12. Note that in addition to the medium tray 6 included in the recording unit 2, an additional medium accommodation unit can be provided under the recording unit 2 or under the liquid container unit 3 in the printer 1.

Medium Transport Path in Printer

A medium transport path in the printer 1 will be described with reference to the drawings. In FIG. 3, the medium transport path of the printer 1 is constituted by an inversion path T1 represented by the thick dotted line, a second path T2 represented by the thick dashed line, a straight path T3 represented by the thick solid line, a discharge path T4 represented by the thin dash-dot line, a first path T5 represented by the thick dash-dot line, a lower medium feed path T6 represented by the thick dash-dot-dot line, and an upper medium feed path T7 represented by the thin dash-dot-dot line.

The inversion path T1 is a path extending from a second position N2, which is the nip position between the inversion roller 20 and a second inversion idler roller 23, to a first position N1, which is the nip position between the inversion roller 20 and a first inversion idler roller 22. The second path T2 is a path extending from the first position N1 to a fourth position N4, which is the nip position of a first transport roller pair 30. The straight path T3 is a path extending from the fourth position N4 to a fifth position N5, which is the nip position of the second transport roller pair 31.

The discharge path T4 is a path extending from the fifth position N5 to a discharge tray 19. The first path T5 is a path extending from the fourth position N4 to the second position N2. The lower medium feed path T6 is a path extending from the pickup position of a pickup roller 16 to a first junction G1 at which the lower medium feed path T6 merges into the inversion path T1. The upper medium feed path T7 is a path extending from the nip position between an upper feed roller 13 and an upper separation roller 14 to a second junction G2 at which the upper medium feed path T7 merges into the second path T2. The constituent elements for the above-described medium transport path will be described later in detail.

In the following, a transport path of a medium fed by the lower supply mechanism 12 from the medium tray 6 will be described first with reference to FIG. 4, and then another transport path of a medium fed by the upper supply mechanism 7 will be described with reference to FIG. 5.

Medium Feeding by Lower Supply Mechanism

Figure 4:
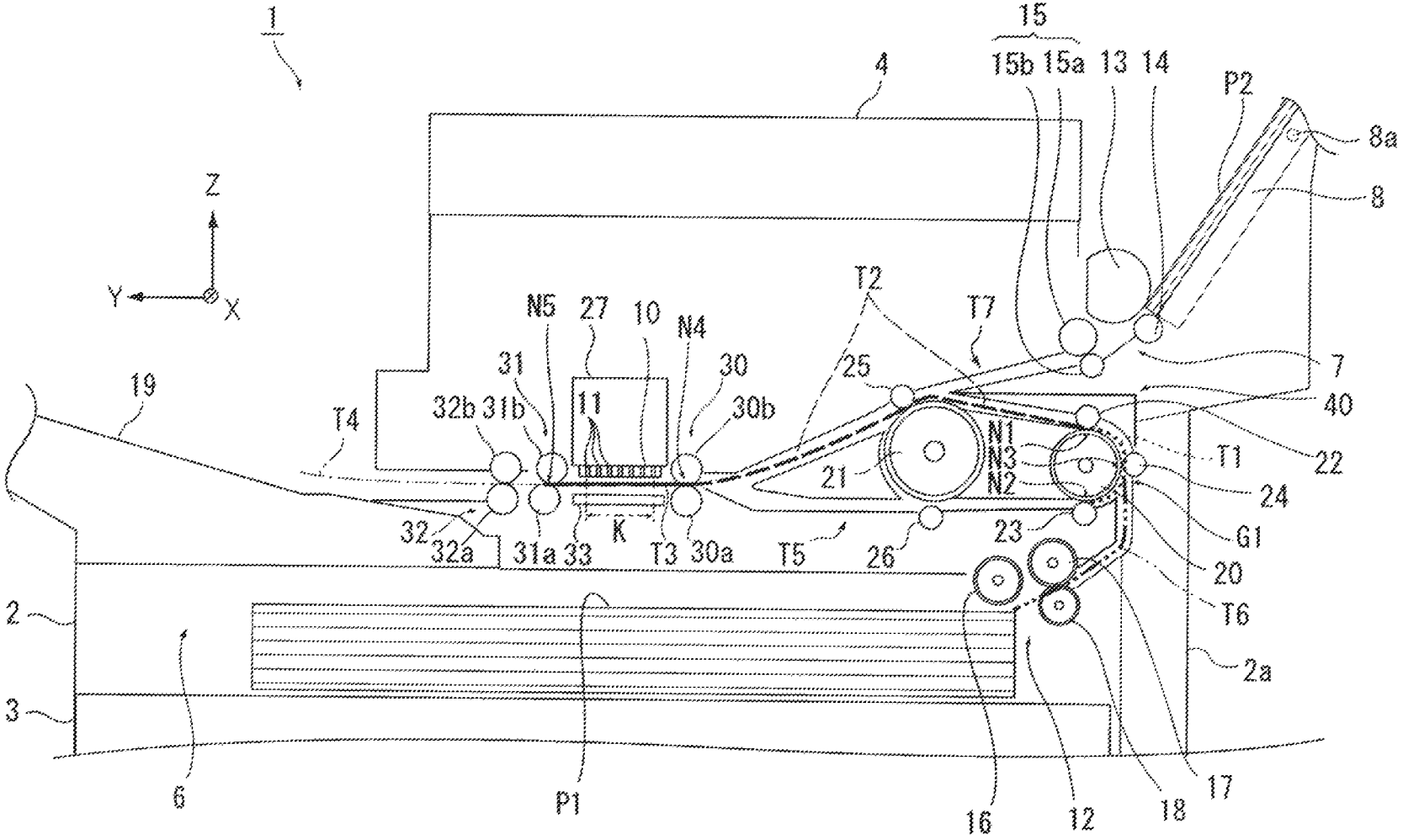
FIG. 4 is a cross-sectional side view schematically illustrating medium transport paths from a lower supply mechanism.
Figure 5:
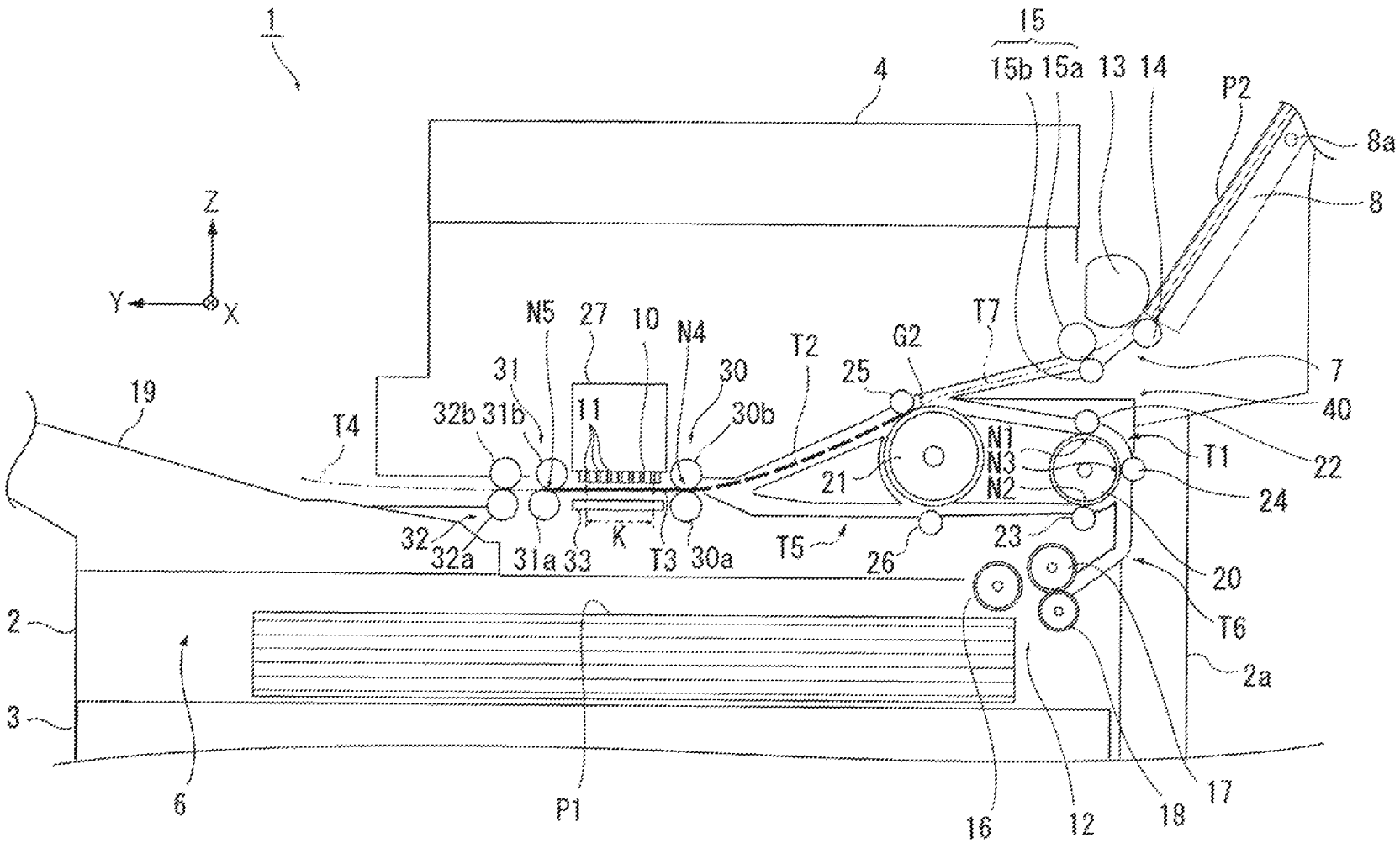
FIG. 5 is a cross-sectional side view schematically illustrating medium transport paths from an upper supply mechanism.

In FIG. 4, reference P1 denotes a stack of media set in the medium tray 6 disposed in a lower portion of the recording unit 2. The lower supply mechanism 12 is provided with the lower medium feed path T6 through which the stack of the media P1 set in the medium tray 6 are fed one by one. The lower medium feed path T6 merges into the inversion path T1 at the first junction G1, which is located upstream of a third position N3. Note that the first junction G1 is shown also in FIG. 3.

The medium tray 6 is disposed below the second inversion idler roller 23, which will be described later. The pickup roller 16, a lower feed roller 17, and a lower separation roller 18, which constitute the lower supply mechanism 12, are disposed between the medium tray 6 and the second inversion idler roller 23.

Figure 6:
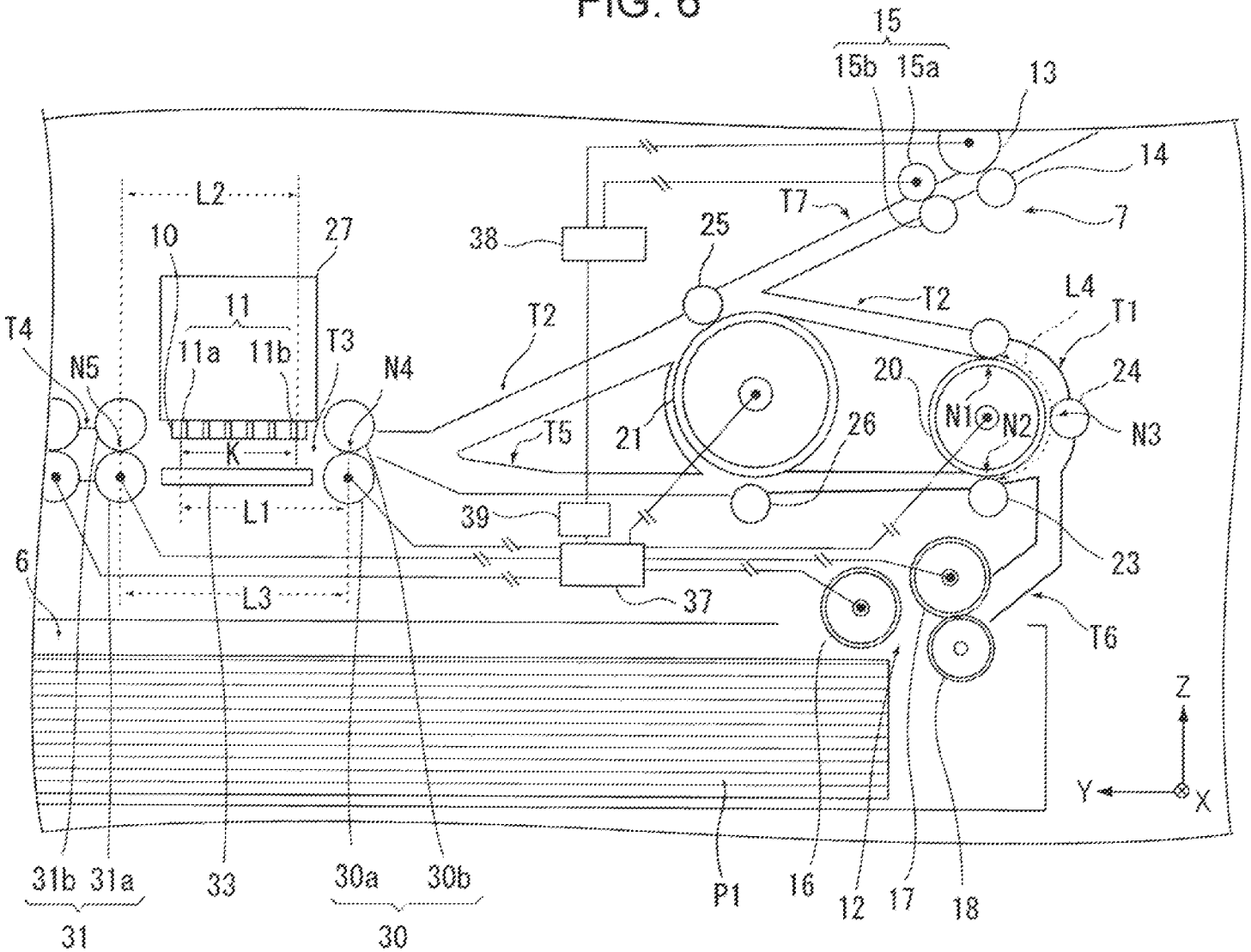
FIG. 6 is a cross-sectional side view schematically illustrating medium transport paths in the printer.

A topmost medium in the stack of media P1 accommodated in the medium tray 6 is first picked up from the medium tray 6 by the pickup roller 16, and the medium is subsequently nipped by the lower feed roller 17 and the lower separation roller 18 and thereby fed into the lower medium feed path T6. In the case of the pickup roller 16 picking up a plurality of media, the media is separated into individual ones by the lower feed roller 17 and the lower separation roller 18. The lower medium feed path T6 is a path through which the medium fed from the medium tray 6 passes. As illustrated in FIG. 6, the pickup roller 16 and the lower feed roller 17 are driven by a first drive source 37. An example of the first drive source 37 is a motor. The first drive source 37 is actuated under the control of a control section 39. Note that in the printer 1, operation related to recording is controlled by the control section 39. The control section 39 also controls operation related to medium transporting, in other words, driving various rollers, as well as recording of the recording head 10, moving the carriage 27, and the like.

The medium enters the inversion path T1 at the first junction G1 where the lower medium feed path T6 merges into the inversion path T1. The printer 1 is configured to perform double-sided recording by which recording is performed on both a first side of a medium and a second side that is opposite to the first side. The inversion path T1 is provided for inverting a medium transported in a reverse transporting direction (−Y direction) that is opposite to the direction of transporting a medium (+Y direction) when the recording head 10 performs recording. Inversion of the medium after first-side recording is completed in the double-sided recording will be described later. The circumferential surface of the inversion roller 20 is formed to serve as the path surface of the inversion path T1. The inversion roller 20 is a roller for applying a transporting force to a medium that passes through the inversion path T1. In the present embodiment, the inversion roller 20 is rotatably driven by receiving power from the first drive source 37 (FIG. 6) under the control of the control section 39.

A first inversion idler roller 22, a second inversion idler roller 23, and a third inversion idler roller 24 are disposed around the inversion roller 20 so as to nip a medium with the inversion roller 20. The first inversion idler roller 22 is disposed above the inversion roller 20 and in collaboration with the inversion roller 20, the first inversion idler roller 22 nips and transports the medium that has been inverted along the inversion path T1. The second inversion idler roller 23 is disposed below the inversion roller 20, and in collaboration with the inversion roller 20, the second inversion idler roller 23 nips and transports a medium prior to the inversion. Put another way, the path surface of the inversion path T1 is formed as part of the circumferential surface of the inversion roller 20 between the first position N1, which is the nip position between the inversion roller 20 and the first inversion idler roller 22, and the second position N2, which is the nip position between the inversion roller 20 and the second inversion idler roller 23. With this configuration, a medium can reliably follow the part of the circumferential surface between the first position N1 and the second position N2 of the inversion roller 20.

Moreover, the third inversion idler roller 24 nips a medium with the inversion roller 20 at the third position N3 located between the first position N1 and the second position N2, which enables the medium to follow the circumferential surface of the inversion roller 20 more reliably.

In the present embodiment, as illustrated in FIGS. 2 and 3, the inversion roller 20 is formed smaller in diameter than an advancing roller 21, which will be described later. In the height direction (Z direction), both of the inversion roller 20 and the first inversion idler roller 22 are positioned so as to overlap the advancing roller 21 as viewed laterally.

The medium that has passed through the inversion path T1 is sent into the second path T2. The second path T2 is a medium transport path after a medium is inverted along the inversion path T1. Note that after a medium passes through the inversion path T1, the medium facing upward when accommodated in the medium tray 6 is inverted so as to face downward. The medium is transported on the second path T2 by the advancing roller 21. Part of the circumferential surface of the advancing roller 21 constitutes the second path T2, which is the transport path of a medium after the medium is inverted by the inversion roller 20. The advancing roller 21 faces both the second path T2 and the first path T5, which will be described later, and applies a transporting force to the medium. In the present embodiment, as illustrated in FIG. 6, the advancing roller 21 is rotatably driven by receiving power from the first drive source 37 under the control of the control section 39.

A first advancing idler roller 25 is disposed above the advancing roller 21. In the second path T2, the advancing roller 21 and the first advancing idler roller 25 nip and transport a medium. A second advancing idler roller 26 is disposed below the advancing roller 21 and nips and transports a medium in collaboration with the advancing roller 21. The second advancing idler roller 26 and the advancing roller 21 nip and transport a medium along the first path T5.

The medium that has been inverted along the inversion path T1 passes through the second path T2 and is sent to a first transport roller pair 30. The first transport roller pair 30 for transporting a medium is disposed upstream of the recording head 10 in the medium transporting direction. The first transport roller pair 30 is constituted by a first transport drive roller 30*a* and a first transport idler roller 30*b*. The first transport drive roller 30*a* comes into contact with a side of a medium opposite to the side on which the recording head 10 performs recording, and the first transport idler roller 30*b* that is rotated passively comes into contact with the side of the medium on which the recording head 10 performs recording.

The second transport roller pair 31 and a third transport roller pair 32 for transporting a medium are disposed downstream of the recording head 10 in the medium transporting direction. The second transport roller pair 31 is constituted by a second transport drive roller 31*a* and a second transport idler roller 31*b*. The second transport drive roller 31*a* comes into contact with the side of the medium opposite to the side on which recording head 10 performs recording, and the second transport idler roller 31*b* that is rotated passively comes into contact with the side of the medium on which the recording head 10 performs recording. The third transport roller pair 32 is constituted by a third transport drive roller 32*a* and a third transport idler roller 32*b*. The third transport drive roller 32*a* comes into contact with the side of the medium opposite to the side on which recording head 10 performs recording, and the third transport idler roller 32*b* that is rotated passively comes into contact with the side of the medium on which the recording head 10 performs recording.

In the present embodiment, as illustrated in FIG. 6, the first transport drive roller 30*a*, the second transport drive roller 31*a*, and the third transport drive roller 32*a* are driven by the first drive source 37 under the control of the control section 39. In the present embodiment, the first drive source 37 is configured as a common drive source to drive the pickup roller 16, the lower feed roller 17, the inversion roller 20, the advancing roller 21, the first transport drive roller 30*a*, the second transport drive roller 31*a*, and the third transport drive roller 32*a*. However, these rollers may be driven by a plurality of drive sources.

The medium is sent into the straight path T3 by the first transport roller pair 30. A region that the recording head 10 opposes on the straight path T3 is a recording region K. A medium support member 33 that supports a medium P is disposed at a position under the recording head 10, in other words, at a position opposing the recording head 10. The recording head 10 performs recording by ejecting ink from the nozzles 11 onto a medium that passes through the recording region K while being supported by the medium support member 33. Note that the medium support member 33 may include an adhesion mechanism to cause a medium to adhere to the supporting surface of the medium support member 33. For example, suction adhesion or electrostatic attraction may be utilized for the adhesion mechanism.

The medium P on which the recording head 10 has performed recording is sent from the straight path T3 into the discharge path T4 by the second transport roller pair 31 and is discharged onto the discharge tray 19 by the third transport roller pair 32.

Medium Feeding by Upper Supply Mechanism

Next, the medium transport path through which the upper supply mechanism 7 feeds a medium will be described with reference to FIG. 5. A medium to be fed by the upper supply mechanism 7 is set in the medium setting section 8. A plurality of media can be set in the medium setting section 8. In FIG. 5, reference P2 denotes a stack of media set in the medium setting section 8. The medium setting section 8 is formed as a hopper that pivotally moves about a pivot 8*a* disposed upstream in the medium transporting direction. As illustrated in FIG. 2, a paper support 34 is disposed upstream of the medium setting section 8 so as to support the rear end of the stack of media P2. The paper support 34 is configured to be storable in an accommodation section 35 provided below the paper support 34 in FIG. 2 and to be withdrawable therefrom.

The upper supply mechanism 7 is constituted by the upper feed roller 13, the upper separation roller 14, a downstream-side feed roller pair 15, and the upper medium feed path T7, which are disposed downstream of the medium setting section 8. The medium setting section 8 pivotally moves such that the movable end of the medium setting section 8 comes closer to the upper feed roller 13. The upper feed roller 13 feeds the topmost medium in the stack of media P2 set in the medium setting section 8 into the upper medium feed path T7. The upper separation roller 14 nips a medium with the upper feed roller 13 so as to separate a plurality of media into individual ones.

The medium fed by the upper feed roller 13 is sent into the upper medium feed path T7 by the downstream-side feed roller pair 15. The downstream-side feed roller pair 15 includes a downstream-side feed drive roller 15*a* and a downstream-side feed idler roller 15*b* that is rotated passively. In the present embodiment, as illustrated in FIG. 6, the second drive source 38 drives the upper feed roller 13 and the downstream-side feed drive roller 15*a*. The second drive source 38 is actuated under the control of the control section 39. Note that the upper feed roller 13 and the downstream-side feed drive roller 15*a* may be driven by the first drive source 37.

The upper medium feed path T7 merges into the second path T2 at the second junction G2 located upstream of the nip position between the advancing roller 21 and the first advancing idler roller 25. The medium that enters the second path T2 at the second junction G2 is sent from the second path T2 to the straight path T3 as is the case for the medium fed from the medium tray 6 by the lower supply mechanism 12. The medium on which recording has been performed is discharged onto the discharge tray 19 via discharge path T4.

Double-Sided Recording

Next, the medium transport path in the case of the double-sided recording will be described. In the case of the double-sided recording, recording is first performed on a first side of a medium supplied by the upper supply mechanism 7 or by the lower supply mechanism 12. Subsequently, the first transport roller pair 30, the second transport roller pair 31, and the third transport roller pair 32 are driven counter to the rotating direction when the recording is performed. The medium is thereby transported in the −Y direction, in other words, in the reverse transporting direction counter to the +Y direction or the medium transporting direction when the recording head 10 performs recording. The medium is transported in the −Y direction along the first path T5 and enters the inversion path T1 where the medium is inverted. In other words, the first path T5 is a medium transport path before the inversion roller 20 inverts the medium. The inversion path T1 is a medium transport path for inverting a medium being transported in the reverse transporting direction, which is opposite to the direction of transporting a medium when the recording head 10 performs recording.

The medium is inverted along the inversion path T1, and when the medium enters the second path T2, the second side of the medium faces upward. In other words, the second side faces the recording head 10. The medium is sent from the second path T2 to the straight path T3 with the second side facing the recording head 10, and recording is performed on the second side in the recording region K on the straight path T3. The medium is consequently discharged onto the discharge tray 19 from the discharge path T4.

When recording is performed onto the first side of a medium by ejecting ink thereto, the freshly recorded first side absorbs ink and thereby expands, which may cause the medium to curl with the first side or the recording surface facing outward and the second side or the non-recording surface facing inward. If the medium curling in such a manner is transported to the recording region K for the subsequent second-side recording with the second side facing the recording head 10, the end of the medium may come into contact with the recording head 10 and may scrape the head surface or get caught and jammed by the recording head 10. Such curling of the medium can be reduced or remedied by stopping the medium or slowing down the medium transport speed on the inversion path T1. Note that reduction or remediation of curling is also referred to as "decurling".

The larger the amount of ink ejected on the first side for recording, the larger the amount of curling occurring to a medium. In the case of decurling a medium that has curled largely, the medium needs to stay in the inversion path T1 for a longer period of time, which leads to a reduction in throughput. In the present embodiment, however, the inversion roller 20 is formed smaller in diameter than the advancing roller 21 as described above. This improves decurling performance in the inversion path T1 and decurls a medium for a shorter period of time compared, for example, with the recording apparatus disclosed by JP-A-2014-196159 in which the inversion roller 20 and the advancing roller 21 have the same diameter. Thus, throughput in double-sided recording can be improved.

Moreover, in the inversion path T1, the medium is nipped at the second position N2 and at the first position N1 so that the medium reliably follows the path surface along the inversion path T1, in other words, the circumferential surface of the inversion roller 20. As a result, the medium can be decurled effectively.

Furthermore, in the height direction, both the inversion roller 20 and the first inversion idler roller 22 are positioned so as to overlap the advancing roller 21 as viewed laterally. In other words, the inversion roller 20 is disposed within a height range of the advancing roller 21, and at least part of the first inversion idler roller 22 is disposed within the height range of the advancing roller 21. Accordingly, the first inversion idler roller 22 can be disposed at a lower position compared with the case where the inversion roller 20 and the advancing roller 21 have the same diameter. Accordingly, the upper supply mechanism 7 located above the first inversion idler roller 22 can be disposed also at a lower position compared with the case where the inversion roller 20 and the advancing roller 21 have the same diameter. Thus, the size of the apparatus can be reduced in the height direction.

In the present embodiment, as illustrated in FIG. 2, both the inversion roller 20 and the first inversion idler roller 22 are positioned, in the height direction (Z direction), so as to entirely overlap the advancing roller 21 as viewed laterally. In other words, both of the inversion roller 20 and the first inversion idler roller 22 are positioned as a whole within the height range of the advancing roller 21, which can thereby provide a larger space above the first inversion idler roller 22. Note that both of the inversion roller 20 and the first inversion idler roller 22 need not be positioned as a whole so as to overlap the advancing roller 21 as viewed laterally. For example, the first inversion idler roller 22 may be disposed such that an upper portion thereof protrudes higher than the advancing roller 21 in the height direction.

In addition, as illustrated in FIG. 2, the inversion roller 20 and the advancing roller 21 are disposed with respective bottom ends being positioned at the same height. In FIG. 2, respective bottom ends of the inversion roller 20 and the advancing roller 21 are at a position Z1, which is the same position in the height direction. Thus, a larger space above the first inversion idler roller 22 can be provided.

In place of the upper supply mechanism 7, another constituent element may be provided above the first inversion idler roller 22. For example, the scanner section 4 may be disposed above the first inversion idler roller 22. In such a case, due to the above configuration of the inversion roller 20 and the first inversion idler roller 22, the size of the apparatus in the height direction can be reduced.

In the medium transport paths of the printer 1 illustrated in FIG. 6, reference L1 denotes the distance, in the medium transporting direction, from the fourth position N4, which is the nip of the first transport roller pair 30, to the most downstream nozzle 11*a* of the recording head 10 (i.e., the nozzle located furthest in the +Y direction), and reference L2 denotes the distance from the fifth position N5, which is the nip of the second transport roller pair 31, to the most upstream nozzle 11*b* of the recording head 10 (i.e., the nozzle located furthest in the −Y direction). Reference L3 denotes the distance from the fourth position N4 to the fifth position N5, and reference L4 denotes the distance from the first position N1 to the second position N2 of the inversion roller 20. In this case, the printer 1 is configured to satisfy both $L1 \leq L4 < L3$ and $L2 \leq L4 < L3$.

Detachable Unit

Figure 7:
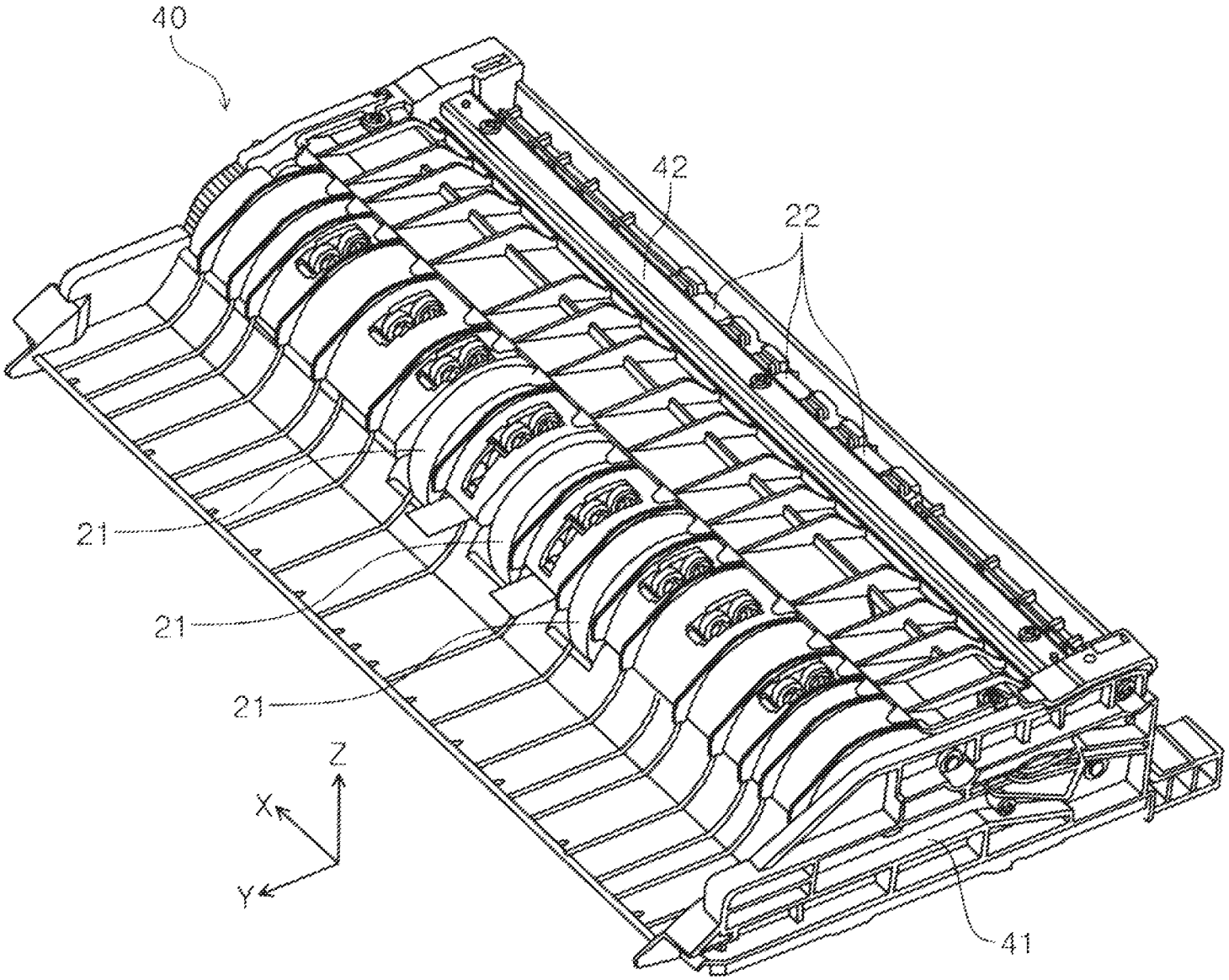
FIG. 7 is a perspective view illustrating a detachable unit.
Figure 8:
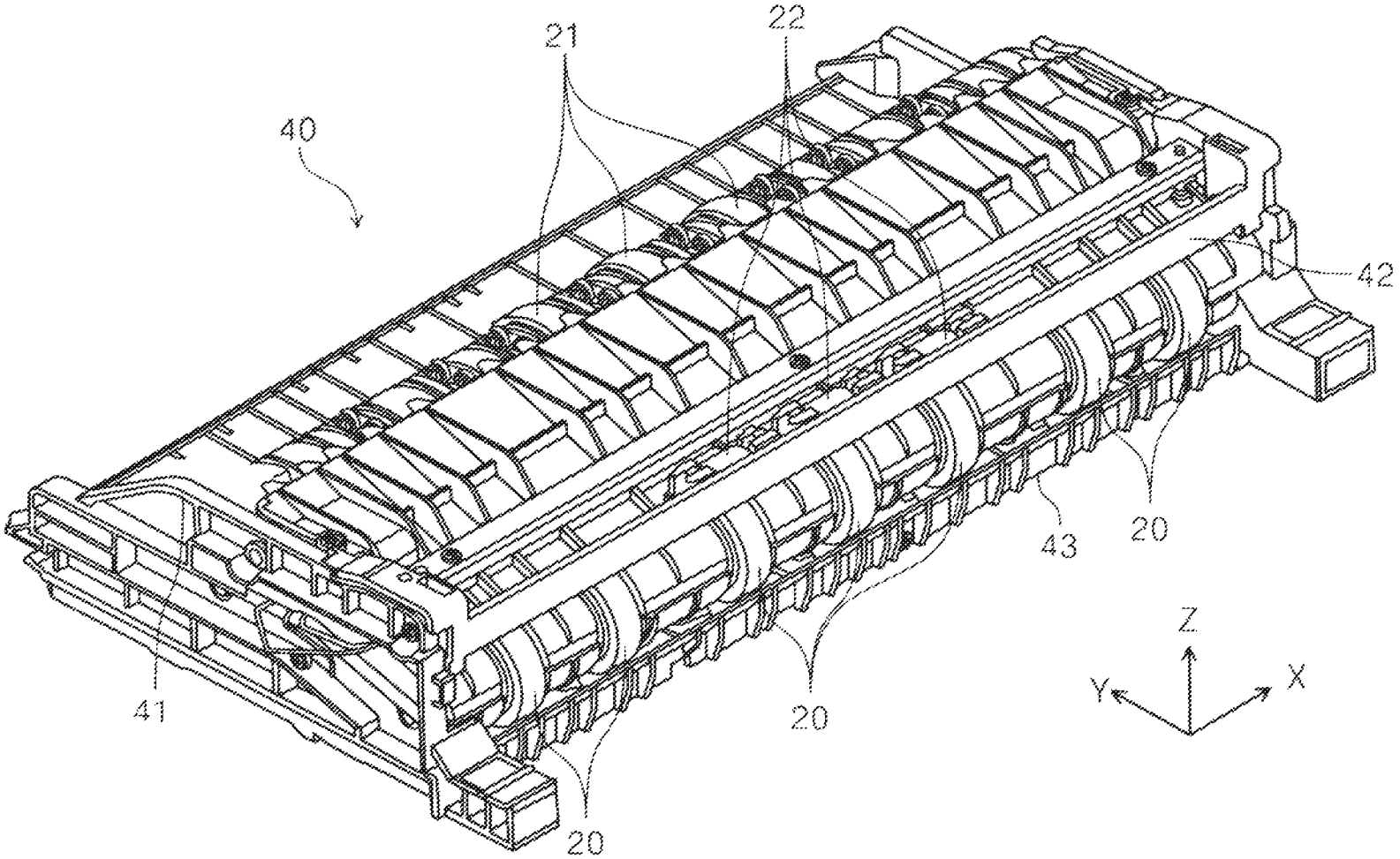
FIG. 8 is a perspective view illustrating the detachable unit of FIG. 7 as viewed from a different angle.

In the present embodiment, the inversion rollers 20, the advancing rollers 21, the first inversion idler rollers 22, and the second inversion idler rollers 23 are disposed in a detachable unit 40 as illustrated in FIGS. 7 and 8. The detachable unit 40 is configured to be detachably mounted in the apparatus body.

As illustrated in FIG. 3, the recording unit 2 is equipped with a rear-side cover 2*a* on the rear side (the side in the −Y direction) of the recording unit 2. Opening the rear-side cover 2*a* provides access to the inside of the apparatus. Note that in FIG. 3, the rear-side cover 2*a* indicated by the dotted line is illustrated as in a state of half open. The rear-side cover 2*a* can be opened, for example, up to about 90 degrees relative to the rear side of the apparatus. The rear-side cover 2*a* includes the third inversion idler rollers 24 attached thereto. While the rear-side cover 2*a* is open, the detachable unit 40 illustrated in FIGS. 7 and 8 can be withdrawn in the −Y direction. Note that the first advancing idler rollers 25 and the second advancing idler rollers 26 are mounted inside the apparatus body.

As illustrated in FIG. 8, the detachable unit 40 includes a base portion 41 on which the inversion rollers 20 and the advancing rollers 21 are rotatably mounted, a first holder 42 on which the first inversion idler rollers 22 are mounted, and a second holder 43 on which the second inversion idler rollers 23 are mounted. A top surface 41*a* of the base portion 41 illustrated in FIG. 9 serves as part of a lower path surface of the second path T2. A bottom surface of the first holder 42 illustrated in FIGS. 7 and 8 serves as part of an upper path surface of the second path T2.

The inversion rollers 20, the advancing rollers 21, the first inversion idler rollers 22, and the second inversion idler rollers 23 are disposed integrally in the detachable unit 40, and the entire unit is detachably mounted in the apparatus body, which thereby facilitates, for example, removal of a jammed sheet from the medium transport path as well as maintenance operation of various rollers.

Figure 9:
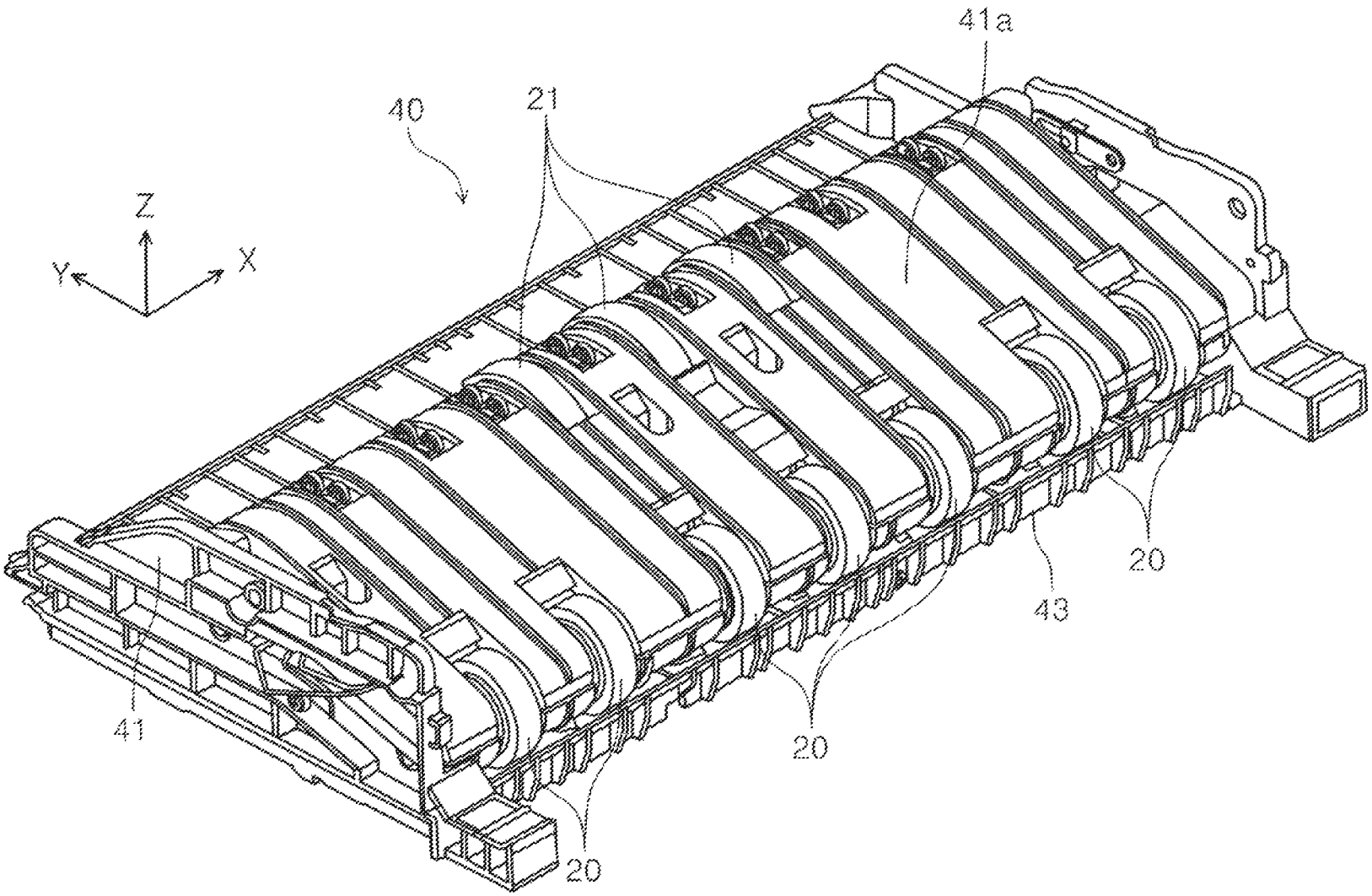
FIG. 9 is a perspective view illustrating the detachable unit of FIG. 8 from which a first holder is removed.

As illustrated in FIG. 9, a plurality of the inversion rollers 20 are provided and spaced apart from each other in the width direction (X direction) that intersects the medium transporting direction (Y direction), and a plurality of the advancing rollers 21 are also provided and spaced apart from each other in the width direction (X direction). By disposing the inversion rollers 20 and the advancing rollers 21 both of which are spaced apart in the width direction, a medium can be transported stably by the inversion rollers 20 and the advancing rollers 21.

The number of the inversion rollers 20 disposed in the width direction is greater than the number of the advancing rollers 21. More specifically, the number of the inversion rollers 20 disposed is seven, whereas the number of the advancing rollers 21 disposed is three. Note that the three advancing rollers 21 are positioned so as to correspond to a central three of the seven inversion rollers 20 in the width direction. Providing more inversion rollers 20 than the advancing rollers 21 leads to a balanced configuration for decurling a medium effectively along the inversion path T1 and for reducing transportation resistance on the first path T5 before inversion and on the second path T2 after inversion.

In the present embodiment, the first advancing idler rollers 25 and the second advancing idler rollers 26, which are idler rollers for the advancing rollers 21, are disposed at respective positions corresponding to the advancing rollers 21 in the width direction. A center region of a medium in the width direction is nipped by the advancing rollers 21 and the first advancing idler rollers 25 or by the advancing rollers 21 and the second advancing idler rollers 26. As a result, the medium can be transported stably.

The first inversion idler rollers 22, the second inversion idler rollers 23, and the third inversion idler rollers 24 are idler rollers for the inversion rollers 20. Among them, the second inversion idler rollers 23 are positioned so as to correspond to all of the seven inversion rollers 20 in the width direction. In other words, the number of the second inversion idler rollers 23 disposed is seven, which is the same as the number of the inversion rollers 20. The first inversion idler rollers 22 and the third inversion idler rollers 24 are disposed at respective positions corresponding to a central three of the seven inversion rollers 20 in the width direction.

Among three groups of inversion idler rollers constituted by the first inversion idler rollers 22, the second inversion idler rollers 23, and the third inversion idler rollers 24, at least one of the three groups has the same number of rollers as that of the inversion rollers 20. As a result, a medium can follow the circumferential surfaces of the inversion rollers 20 more reliably, which brings about a favorable decurling effect on the medium. The number of idler rollers in the other groups is smaller than the number of the inversion rollers 20, and thereby the transportation resistance in the inversion path T1 can be reduced.

Control Operation of Control Section.

In the case of double-sided recording on both the first side of a medium and the second side that is opposite to the first side, when a medium is sent to the inversion path T1 following the first-side recording and the leading end of the medium is nipped at the second position N2, in other words, the control section 39 can perform a first control operation by which the transport speed of a medium is made slower than the transport speed set for recording when the leading end of the medium is located between the first position N1 and the second position N2 of the inversion path T1. The first control operation, by which the transport speed of the medium is made slower than that during recording, includes a case where the medium is stopped and the transport speed becomes zero.

As described above, in the double-sided recording, if a medium curls after the first-side recording in such a manner that the leading end of the medium bends upward while the second side faces the recording head 10, the end of the medium may scrape the head surface or get caught and jammed by the recording head 10. Due to the control section 39 performing the first control operation during the second-side recording, the curling medium of which the leading end bends upward can be decurled by the curve of the inversion path T1. This can relieve the problem such as medium scraping of the recording head 10 or medium jamming near the recording head 10 during the second-side recording in the double-sided recording.

The control section 39 may be configured to perform the first control operation in response to the amount of ink ejected on the first side. The more the amount of ink ejected on the first side, the more the amount of curling occurring after the first-side recording. Accordingly, if the amount of ink ejected on the first side is small, the curling does not tend to be large. For example, in the case of recording in which the discharge amount of ink is small and the curling does not cause the leading end of medium to come into contact with the head surface when the second side faces the recording head 10, the control section 39 may omit to perform the first control operation. This can reduce the likelihood of the throughput decreasing due to the first control operation. More specifically, a trailing end region of a medium during first-side recording in the medium transporting direction becomes a leading end region of the medium during second-side recording. Accordingly, when recording is performed on the trailing end region during the first-side recording with the discharge amount of ink per unit area being equal to or more than a predetermined amount, the control section 39 may perform the first control operation. This can favorably relieve the above problem occurring when a medium is transported with the second side facing the recording head 10 and can simultaneously suppress the likelihood of the throughput decreasing.

Figure 10:
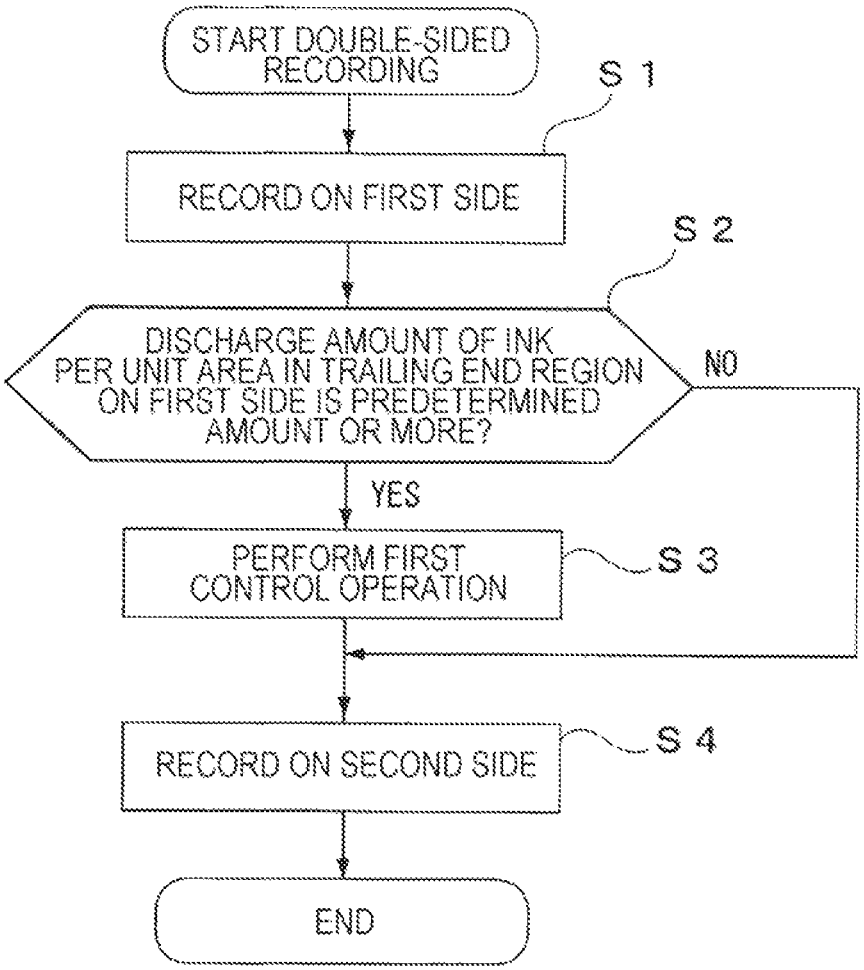
FIG. 10 is a flow chart illustrating control operation of a control section.

Next, the control operation performed by the control section 39 will be described with reference to the flow chart in FIG. 10. In the case of double-sided recording, in step S1, the control section 39 performs recording on the first side. Subsequently, in step S2, the control section 39 determines whether or not the discharge amount of ink per unit area in the trailing end region on the first side is equal to or more than a predetermined amount. If YES in step S2, in other words, if the discharge amount of ink per unit area in the trailing end region on the first side is determined to be equal to or more than the predetermined amount, the control section 39 advances the processing to step S3 and performs the first control operation, and subsequently, in step S4, the control section 39 performs recording on the second side. This can suppress curling occurring to the leading end when the medium is transported with the second side facing the recording head 10.

If NO in step S2, in other words, if the discharge amount of ink per unit area in the trailing end region on the first side is less than the predetermined amount, curling of the leading end of the medium transported with the second side facing the recording head 10 is not expected to lead to the above problem. Consequently, the control section 39 advances the processing to step S4 without performing the first control operation in step S3 and performs recording on the second side. This enables the double-sided recording to be performed with a favorable throughput compared with the case of performing the first control operation. Note that the determination of step S2 may be made by the control section 39 before recording is performed on the first side in step S1 and when the control section 39 obtains contents data for the first-side recording.

One embodiment has been described. Note that the disclosure is not limited to the embodiment described above and various modifications can be made within the scope of the disclosure set forth in the claims. Thus, all such modifications are intended to be included within the scope of the disclosure.

What is claimed is:

1. A recording apparatus, comprising:

a recording device that performs recording onto a medium;

an inversion path that inverts the medium transported in a reverse transporting direction that is opposite to a medium transporting direction while the recording device performing recording;

an inversion roller having a circumferential surface that serves as a path surface of the inversion path, the inversion roller applying a transporting force to the medium;

an advancing roller having a circumferential surface that faces both a first path that is a medium transport path before the medium is inverted by the inversion roller and a second path that is a medium transport path after the medium is inverted, the advancing roller applying a transporting force to the medium;

a first inversion idler roller that is disposed above the inversion roller and nips and transports the medium after the inversion in collaboration with the inversion roller; and an upper supply mechanism that is disposed above the first inversion idler roller and supplies the medium toward the recording device, wherein the inversion roller is made smaller in diameter than the advancing roller, and the inversion roller is positioned within a height range in which the advancing roller extends in a height direction, and at least part of the first inversion idler roller is positioned within the height range of the advancing roller.

2. The recording apparatus according to claim 1, wherein both of the inversion roller and the first inversion idler roller are positioned as a whole within the height range of the advancing roller.

3. The recording apparatus according to claim 1, wherein the inversion roller and the advancing roller have respective bottom ends that are disposed at the same position in the height direction.

4. The recording apparatus according to claim 1, further comprising:

a first advancing idler roller that is disposed above the advancing roller and nips and transports the medium in collaboration with the advancing roller, wherein the upper supply mechanism includes an upper medium feed path that merges into the second path at a position upstream of the nip between the advancing roller and the first advancing idler roller.

5. The recording apparatus according to claim 1, further comprising:

a second inversion idler roller that is disposed below the inversion roller and nips and transports the medium before the inversion in collaboration with the inversion roller, wherein the path surface of the inversion path is the circumferential surface of the inversion roller between a first position that is the nip between the inversion roller and the first inversion idler roller and a second position that is the nip between the inversion roller and the second inversion idler roller.

6. The recording apparatus according to claim 5, further comprising:

a detachable unit that is attachable to and detachable from the apparatus body, wherein the inversion roller, the advancing roller, the first inversion idler roller, and the second inversion idler roller are disposed in the detachable unit.

7. The recording apparatus according to claim 5, further comprising:

a third inversion idler roller that nips the medium with the inversion roller at a third position located between the first position and the second position; and a lower supply mechanism that supplies the medium toward the recording device from a medium accommodation section disposed below the second inversion idler roller, wherein the lower supply mechanism includes a lower medium feed path that merges into the inversion path at a position upstream of the third position.

8. The recording apparatus according to claim 5, further comprising:

a first transport roller pair that nips and transports the medium at a position located upstream of the recording device in the medium transporting direction; and a second transport roller pair that nips and transports the medium at a position located downstream of the recording device in the medium transporting direction, wherein the recording device includes a plurality of nozzles that are spaced apart from each other in the medium transporting direction and is configured to perform recording by ejecting liquid from the nozzles onto the medium, and both $L1 \leq L4 < L3$ and $L2 \leq L4 < L3$ are satisfied, wherein, in the medium transporting direction, L1 is a distance from a fourth position that is the nip of the first transport roller pair to the most downstream nozzle of the recording device, L2 is a distance from a fifth position that is the nip of the second transport roller pair to the most upstream nozzle of the recording device, L3 is a distance from the fourth position to the fifth position, and L4 is a distance along the inversion path from the first position to the second position.

9. The recording apparatus according to claim 8, further comprising:

a control section that controls transport of the medium, wherein in a case of double-sided recording on both a first side of the medium and a second side that is opposite to the first side, the control section is configured to perform a first control operation by which a medium transport speed is made slower than a medium transport speed set for recording when the medium is sent to the inversion path following first-side recording and a leading end of the medium is nipped at the second position.

10. The recording apparatus according to claim 9, wherein the control section performs the first control operation in response to an amount of liquid ejected on the first side.

11. The recording apparatus according to claim 1, wherein a plurality of the inversion rollers are provided and spaced apart from each other in a width direction that intersects the medium transporting direction, and a plurality of the advancing rollers are provided and spaced apart from each other in the width direction.

12. The recording apparatus according to claim 11, wherein the number of the inversion rollers are greater than the number of the advancing rollers.

* * * * *